US009364058B1

(12) United States Patent
Hsieh

(10) Patent No.: US 9,364,058 B1
(45) Date of Patent: Jun. 14, 2016

(54) TELESCOPIC STICK MECHANISM FOR AUTOMATIC UMBRELLA

(71) Applicant: Ai-Hui Huang, Changhua Hsien (TW)

(72) Inventor: David Hsieh, Changhua Hsien (TW)

(73) Assignee: Ai-Hui Huang, Changhua Hsien (TW)

( * ) Notice: Subject to any disclaimer, the term of this patent is extended or adjusted under 35 U.S.C. 154(b) by 0 days.

(21) Appl. No.: 14/660,039

(22) Filed: Mar. 17, 2015

(51) Int. Cl.
*A45B 19/04* (2006.01)
*A45B 25/14* (2006.01)
*A45B 9/00* (2006.01)

(52) U.S. Cl.
CPC . *A45B 19/04* (2013.01); *A45B 9/00* (2013.01); *A45B 25/143* (2013.01); *A45B 2009/007* (2013.01)

(58) Field of Classification Search
CPC ..... A45B 19/04; A45B 19/08; A45B 25/143; A45B 25/14
See application file for complete search history.

(56) References Cited

U.S. PATENT DOCUMENTS 2,168,188 A * 8/1939 Bernhard ..... A45B 19/04 135/25.41
5,803,102 A * 9/1998 Ko ..... A45B 25/143 135/22
6,145,522 A * 11/2000 Ko ..... A45B 25/16 135/24
6,173,722 B1 * 1/2001 Ko ..... A45B 25/143 135/22
8,365,747 B1 * 2/2013 Su ..... A45B 25/16 135/22
8,522,805 B2 * 9/2013 Tan ..... A45B 25/16 135/24
8,544,485 B2 * 10/2013 Ko ..... A45B 25/143 135/24
8,684,018 B1 * 4/2014 Ni ..... A45B 25/14 135/20.3
8,726,920 B2 * 5/2014 Ko ..... A45B 19/04 135/24
8,757,184 B1 * 6/2014 Chen ..... A45B 19/04 135/20.3
8,800,576 B2 * 8/2014 Chang ..... A45B 25/16 135/22
8,820,337 B2 * 9/2014 Hsieh ..... A45B 25/143 135/22
2014/0373886 A1 * 12/2014 Ko ..... A45B 25/16 135/22

* cited by examiner

*Primary Examiner* — David R Dunn
*Assistant Examiner* — Danielle Jackson

(57) ABSTRACT

A telescopic stick mechanism for an automatic umbrella at least contains: a first stick section and a second stick section. The second stick section is fitted with and slides on the first stick section. The first stick section includes a first plug, and the second stick section includes a second plug. The first plug has a first through orifice defined therein, the second stick section also includes a first support member, and an upper end of the first support member is connected with the second plug, a lower end of the first support member is inserted into the first through orifice. The first stick section also includes a first pull rope fitted therein and coupling with the lower end of the first support member via a first fixing tab on the first plug, and a lower end of the first pull rope is rolled on the rolling mechanism.

6 Claims, 7 Drawing Sheets

TELESCOPIC STICK MECHANISM FOR AUTOMATIC UMBRELLA

FIELD OF THE INVENTION

The present invention relates to a telescopic stick mechanism for an automatic umbrella.

BACKGROUND OF THE INVENTION

A conventional umbrella contains a button for being pressed by a user to stretch a plurality of stretchers, thereafter the button is pressed again so that the plurality of stretchers are retracted to press a stick assembly, thus folding the umbrella.

Another conventional umbrella is manually stretched and folded, for example, a button on the umbrella is pressed to retract a plurality of stretchers and a stick assembly, thus folding the umbrella manually.

However, each of such conventional umbrellas contains a telescopic spring fitted in the stick assembly and contains plural driving springs fixed on the plurality of stretchers, such that the conventional umbrellas are stretched by ways of the telescopic spring and are retracted by using the plural driving spring.

However, such conventional umbrellas cannot be operated automatically. Furthermore, the stick assembly is not operated stably and safely.

The present invention has arisen to mitigate and/or obviate the afore-described disadvantages.

SUMMARY OF THE INVENTION

The primary objective of the present invention is to provide a telescopic stick mechanism for an automatic umbrella which is simplified by using at least one support member and at least one pull rope to replace a spring assembly in a conventional stick assembly of the automatic umbrella.

To obtain the above objective, a telescopic stick mechanism for an automatic umbrella provided by the present invention contains: a first stick section and a second stick section. The second stick section is fitted with and slides on an outer wall of the first stick section.

The first stick section includes a first plug disposed on a top end thereof, and the second stick section includes a second plug mounted on a top end thereof, wherein the first plug of the first stick section has a first through orifice defined thereon, the second stick section also includes a first support member fixed therein, and an upper end of the first support member is in connection with the second plug, a lower end of the first support member is inserted into the first through orifice of the first stick section. The first stick section also includes a first pull rope fitted therein and coupling with the lower end of the first support member via a first fixing tab on the first plug, and a lower end of the first pull rope is rolled on the rolling mechanism.

The telescopic stick mechanism for the automatic umbrella further contains a third stick section fitted with and sliding on an outer wall of the second stick section, wherein the third stick section includes a third plug fixed on a top end thereof, and the second plug of the second stick section has a second through orifice formed thereon, the third stick section also includes a second support member disposed thereon, wherein an upper end of the second support member is coupled with the third plug, and a lower end of the second support member is inserted into the first support member formed in the cylinder shape via the second through orifice of the second stick section, the second stick section further includes a second pull rope fitted therein and having an upper segment for joining with the lower end of the second support member via the second fixing tab on the second plug, and a lower segment of the second pull rope is joined with the first plug.

Preferably, the second support member is formed in any one of a sheet shape, a bar shape, and a cylinder shape.

Thereby, the telescopic stick mechanism for the automatic umbrella which is simplified by using the at least one support member and the at least one pull rope to replace the spring assembly in the conventional stick assembly of the automatic umbrella Preferably, the first support member is formed in the cylinder shape, so the second support member is inserted into the first support member as retracting the automatic umbrella.

DETAILED DESCRIPTION OF THE PREFERRED EMBODIMENTS

A telescopic stick mechanism is applicable for an automatic umbrella with at least two stick sections.

Figure 1:
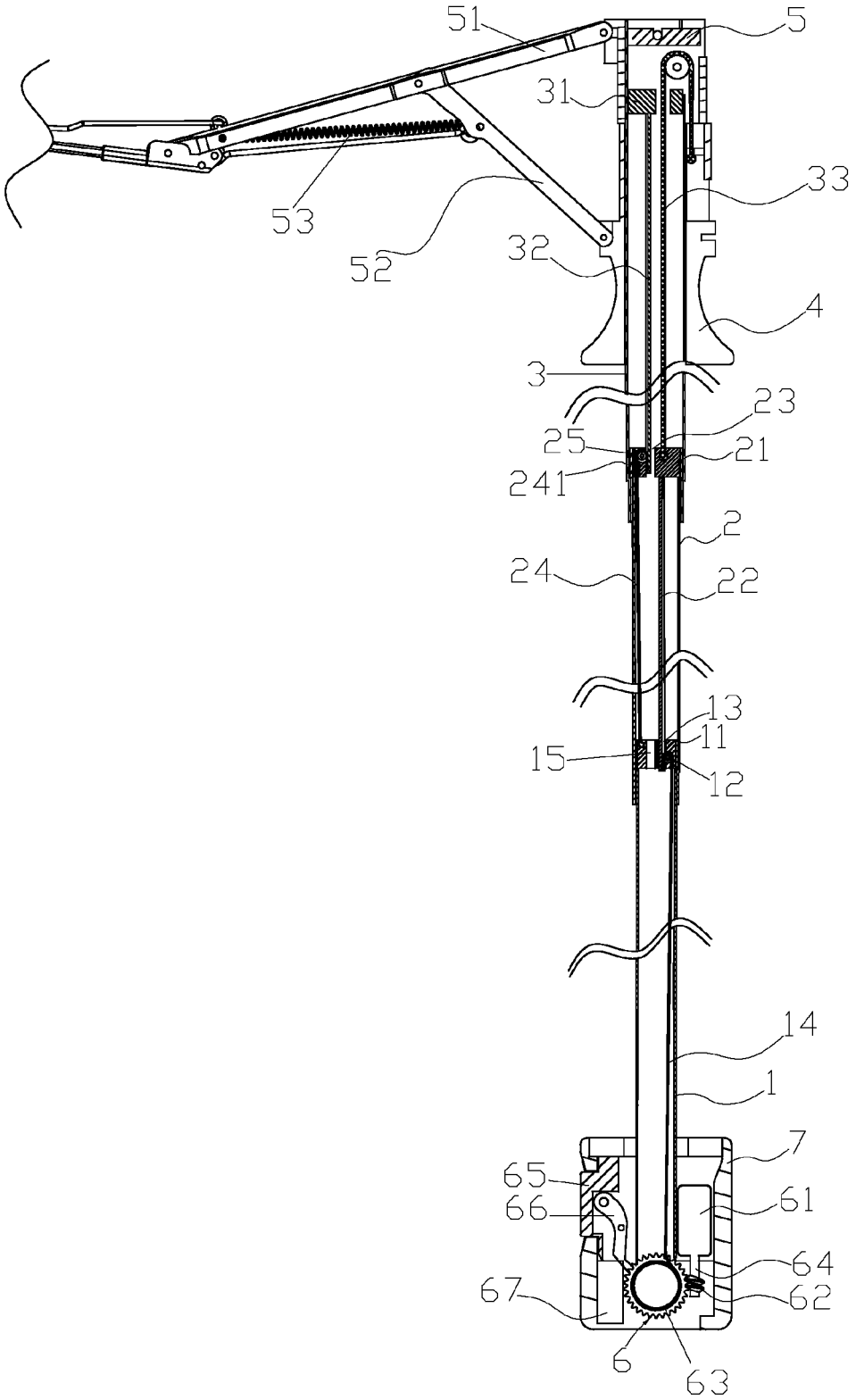
FIG. 1 is a cross sectional view showing the operation of a telescopic stick mechanism for an automatic umbrella according to a first embodiment of the present invention.
Figure 2:
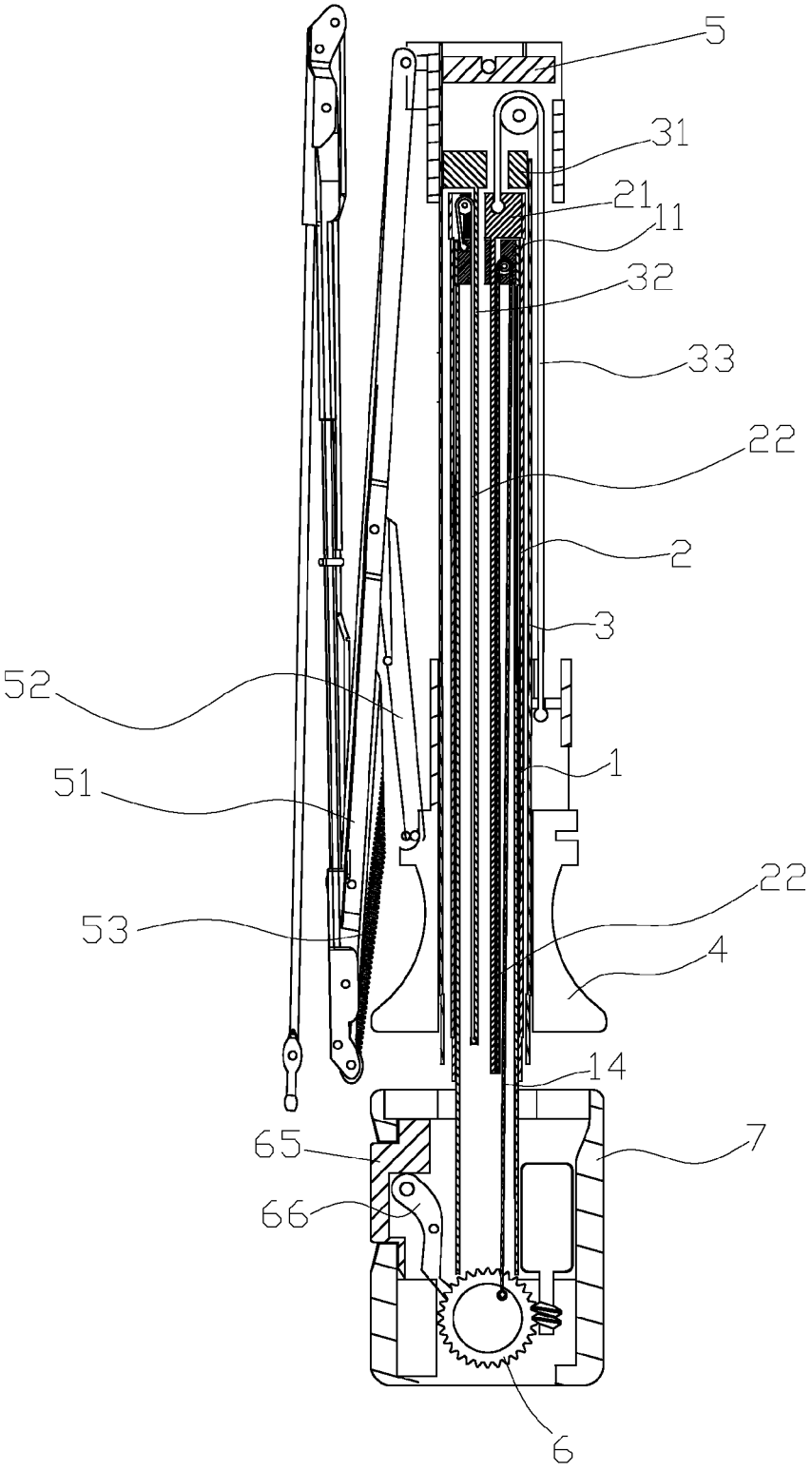
FIG. 2 is another cross sectional view showing the operation of the telescopic stick mechanism for the automatic umbrella according to the first embodiment of the present invention.

For example, as shown in FIGS. 1 and 2, a telescopic stick mechanism for an automatic umbrella according to a first embodiment of the present invention comprises: a first stick section 1, a second stick section 2, and a third stick section 3. The second stick section 2 is fitted with and slides on an outer wall of the first stick section 1, and the first stick section 1 includes a first plug 11 disposed on a top end thereof, the second stick section 2 includes a second plug 21 mounted on a top end thereof, the first plug 11 of the first stick section 1 has a first through orifice 12 defined thereon, and the second stick section 2 also includes a first support member 22 fixed therein, wherein an upper end of the first support member 22 is connected with the second plug 21, and a lower end of the first support member 22 is inserted into the first through orifice 12 of the first stick section 1. The first stick section 1 also includes a first pull rope 14 fitted therein and connecting with the lower end of the first support member 22 via a first fixing tab 13 on the first plug 11. The third stick section 3 is fitted with and slides on an outer wall of the second stick section 2, and the third stick section 3 includes a third plug 31 fixed on a top end thereof, and the second plug 21 of the second stick section 2 has a second through orifice 23 formed thereon. The third stick section 3 also includes a second support member 32 disposed thereon, wherein an upper end of the second support member 32 is coupled with the third plug 31, and a lower end of the second support member 32 is inserted into the second through orifice 23 of the second stick section 2. The second stick section 2 further includes a second pull rope 24 fitted therein and having an upper segment 241 for joining with the lower end of the second support member 32 via a second fixing tab 25 on the second plug 21. In addition, the first plug 1 has a third through orifice 15 defined thereon to insert the second support member 32.

Figure 3:
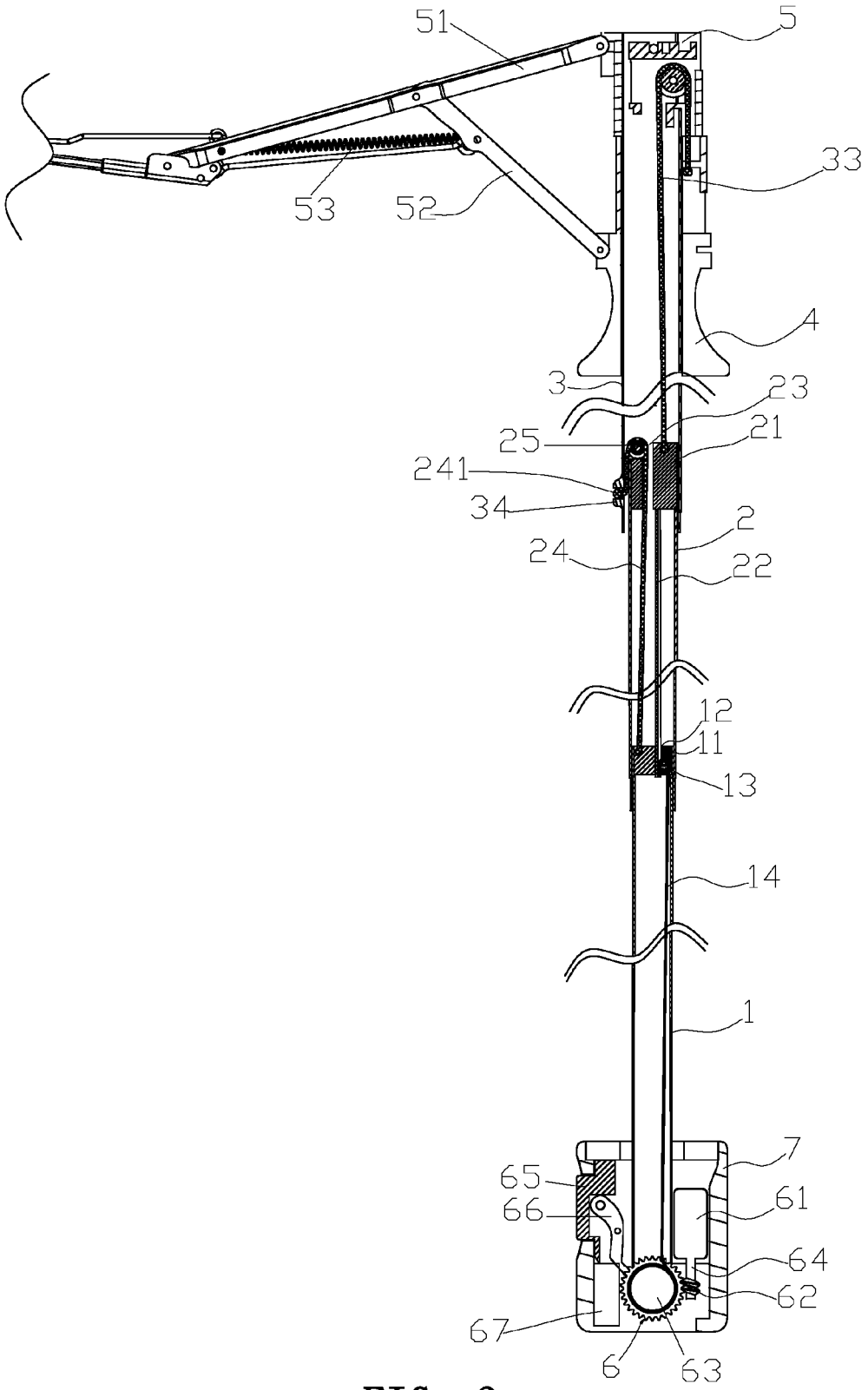
FIG. 3 is a cross sectional view showing the operation of a telescopic stick mechanism for an automatic umbrella according to a second embodiment of the present invention.
Figure 4:
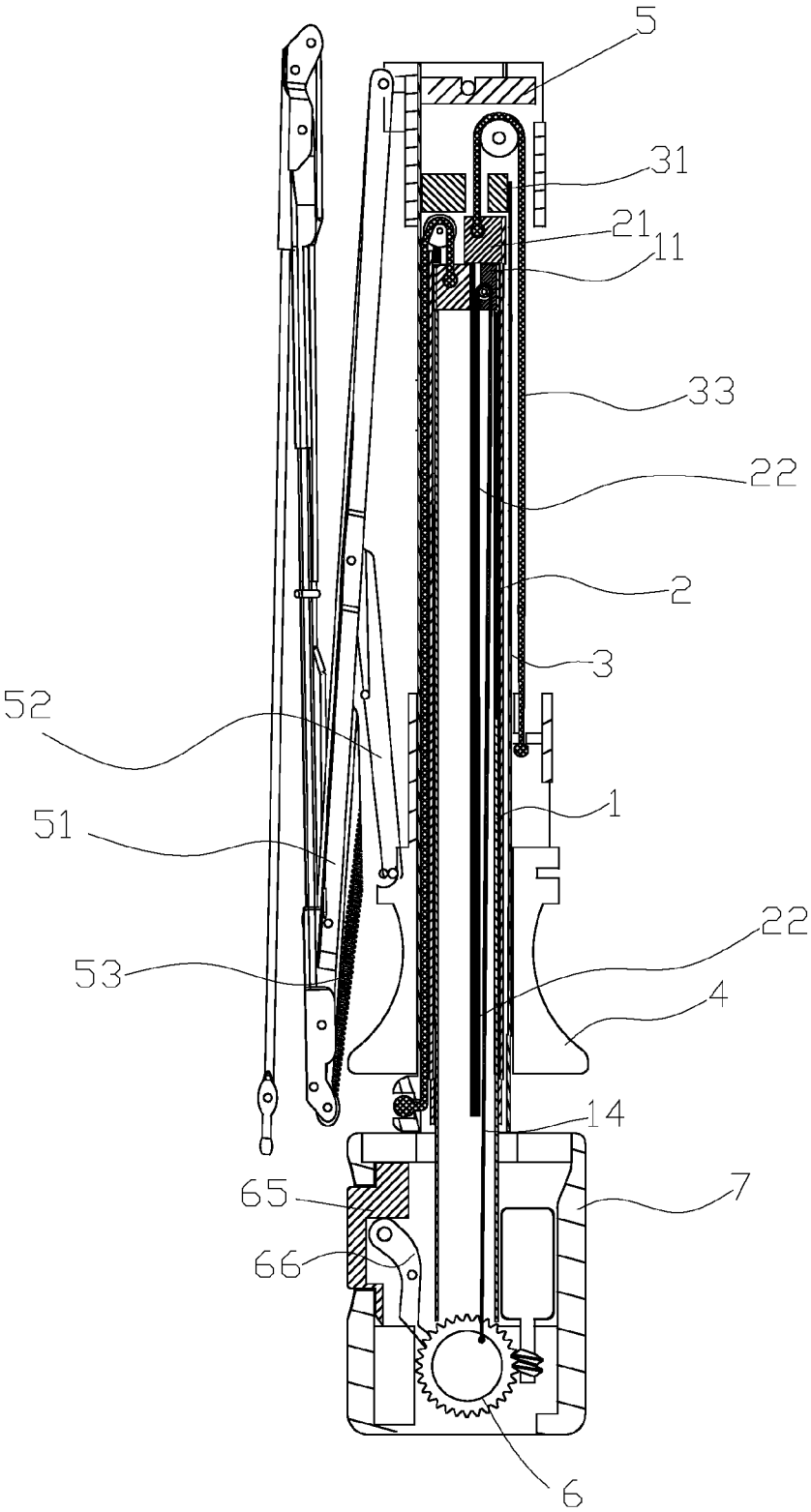
FIG. 4 is another cross sectional view showing the operation of the telescopic stick mechanism for the automatic umbrella according to the second embodiment of the present invention.

With reference to FIGS. 3 and 4, a telescopic stick mechanism for an automatic umbrella according to a second embodiment of the present invention comprises: a first stick section 1, a second stick section 2, and a third stick section 3. The second stick section 2 is fitted with and slides on an outer wall of the first stick section 1, the first stick section 1 includes a first plug 11 disposed on a top end thereof, and the second stick section 2 includes a second plug 21 mounted on a top end thereof, wherein the first plug 11 of the first stick section 1 has a first through orifice 12 defined thereon, the second stick section 2 also includes a first support member 22 fixed therein, and an upper end of the first support member 22 is in connection with the second plug 21, a lower end of the first support member 22 is inserted into the first through orifice 12 of the first stick section 1. The first stick section 1 also includes a first pull rope 14 fitted therein and coupling with the lower end of the first support member 22 via a first fixing tab 13 on the first plug 11. The third stick section 3 is fitted with and slides on an outer wall of the second stick section 2, and the second stick section 2 further includes a second pull rope 24 fitted therein and having an upper segment 241 for joining with a lower segment 34 of the third stick section 3 through a second fixing tab 25 of the second plug 21, wherein a lower end of the second pull rope 24 is coupled with the first plug 11.

Each third stick section 3 of the first embodiment and the second embodiment further includes a lower runner 4 fitted thereon and an upper runner 5 mounted on an upper end thereof, wherein the upper runner 5 has plural first stretchers 51, plural second stretchers 52 fixed between the plural first stretchers 51 and the lower runner 4, and plural springs 53 fitted between the plural second stretchers 52 and the plural first stretchers 51. The first stick section 1 further includes a rolling mechanism 6 fixed in a handle 7, wherein a lower end of the first pull rope 14 is rolled on the rolling mechanism 6. The rolling mechanism 6 includes a micro motor 61 driven by a battery 67 and includes a rotating gear 63, wherein the micro motor 61 drives the rotating gear 63 to retract the first pull rope 14 through a driving gear 62 mounted on an output wheel 64, such that when the first pull rope 14 is rolled, its upper end pulls the first support member 22 upwardly, and the second stick section 2 is driven by the first support member 22 to slide upwardly.

As shown in FIGS. 1 and 2, in operation, the upper segment 241 of the second pull rope 24 in the second stick section 2 pulls the second support member 32 upwardly, such that the third stick section 3 is driven by the second support member 32 to slide upwardly, thus stretching the first stick section 1, the second stick section 2, and the third stick section 3 completely. Furthermore, the third stick section 3 drives the plural first stretchers 51 and the plural second stretchers 52 to stretch outwardly. In the meantime, the first pull rope 14 is rolled by the rolling mechanism 6, and a button 65 controls a retaining piece 66 to engage with the rotating gear 63, thus fixing the automatic umbrella which is stretched.

With reference to FIGS. 3 and 4, in operation, the upper segment 241 of the second pull rope 24 in the second stick section 2 pulls the third stick section 3 upwardly, such that the first stick section 1, the second stick section 2, and the third stick section 3 are stretched completely. Furthermore, the third stick section 3 and the third pull rope 33 pull the plural first stretchers 51 and the plural second stretchers 52 to stretch outwardly. In the meantime, the first pull rope 14 is rolled by the rolling mechanism 6, and a button 65 controls a retaining piece 66 to engage with the rotating gear 63, thus fixing the automatic umbrella which is stretched. As desiring to fold the automatic umbrella, the button 66 controls the retaining piece 66 to disengage from the rotating gear 63, the plural springs 53 pull the plural first stretchers 51 and the plural second stretchers 52 inwardly, and the first pull rope 14 is pulled downwardly by the first support member 22, the second pull rope 24 is pulled downwardly by the second support member 32, and the third pull rope 33 is pulled downwardly by the lower runner 4, thus folding the automatic umbrella.

Figure 5:
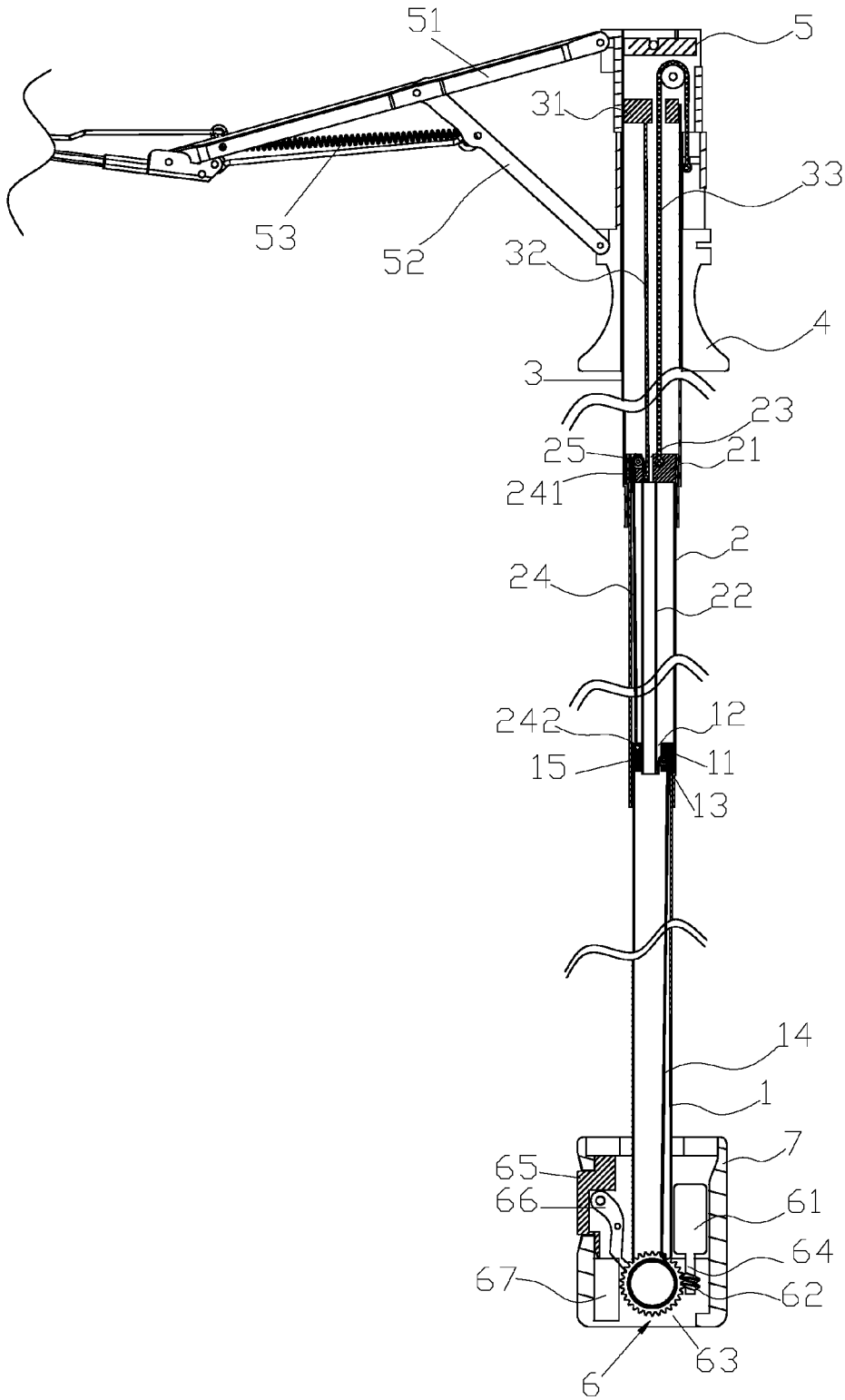
FIG. 5 is also another cross sectional view showing the operation of the telescopic stick mechanism for the automatic umbrella according to the second embodiment of the present invention.
Figure 6:
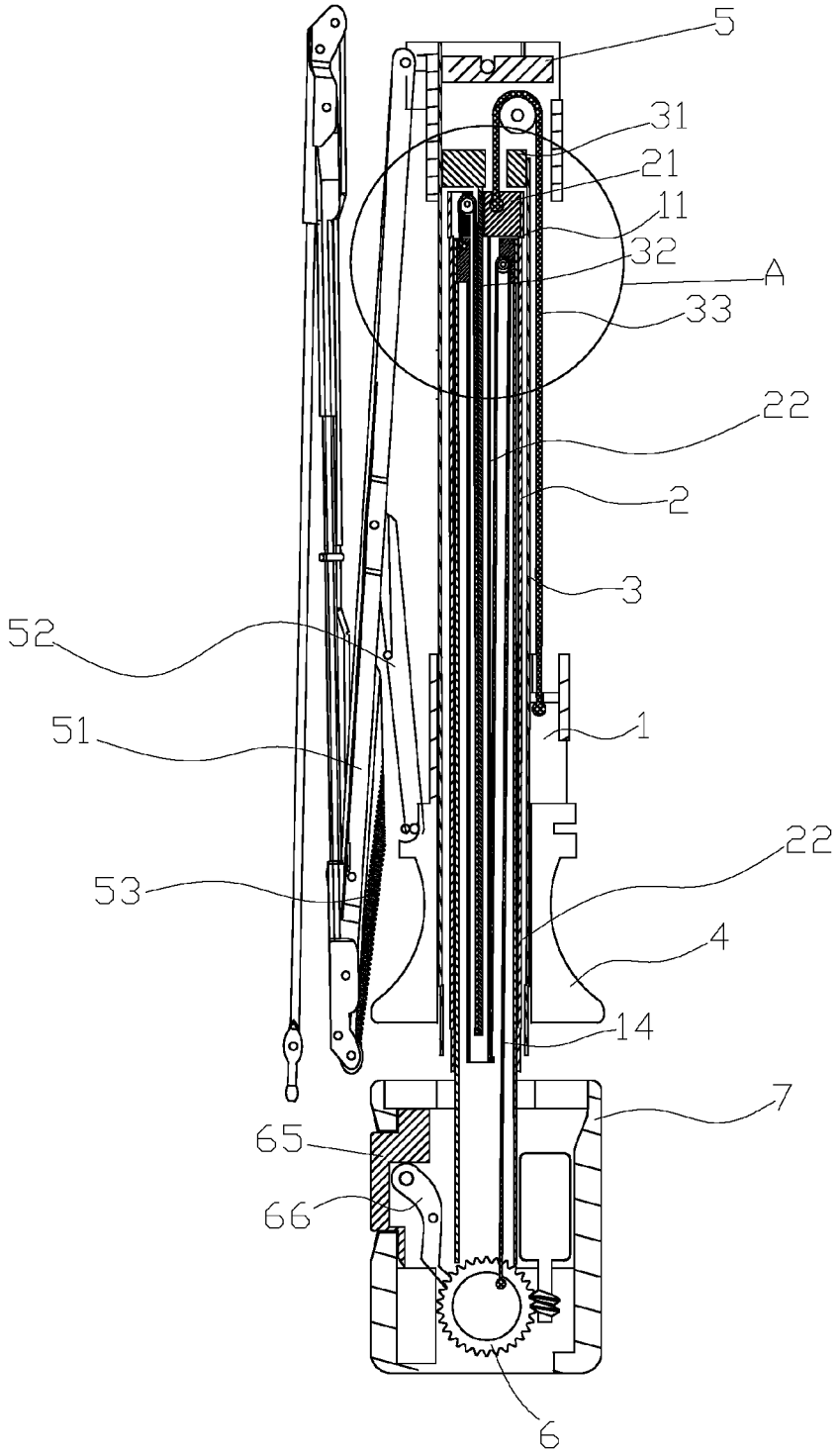
FIG. 6 is still another cross sectional view showing the operation of the telescopic stick mechanism for the automatic umbrella according to the second embodiment of the present invention.
Figure 7:
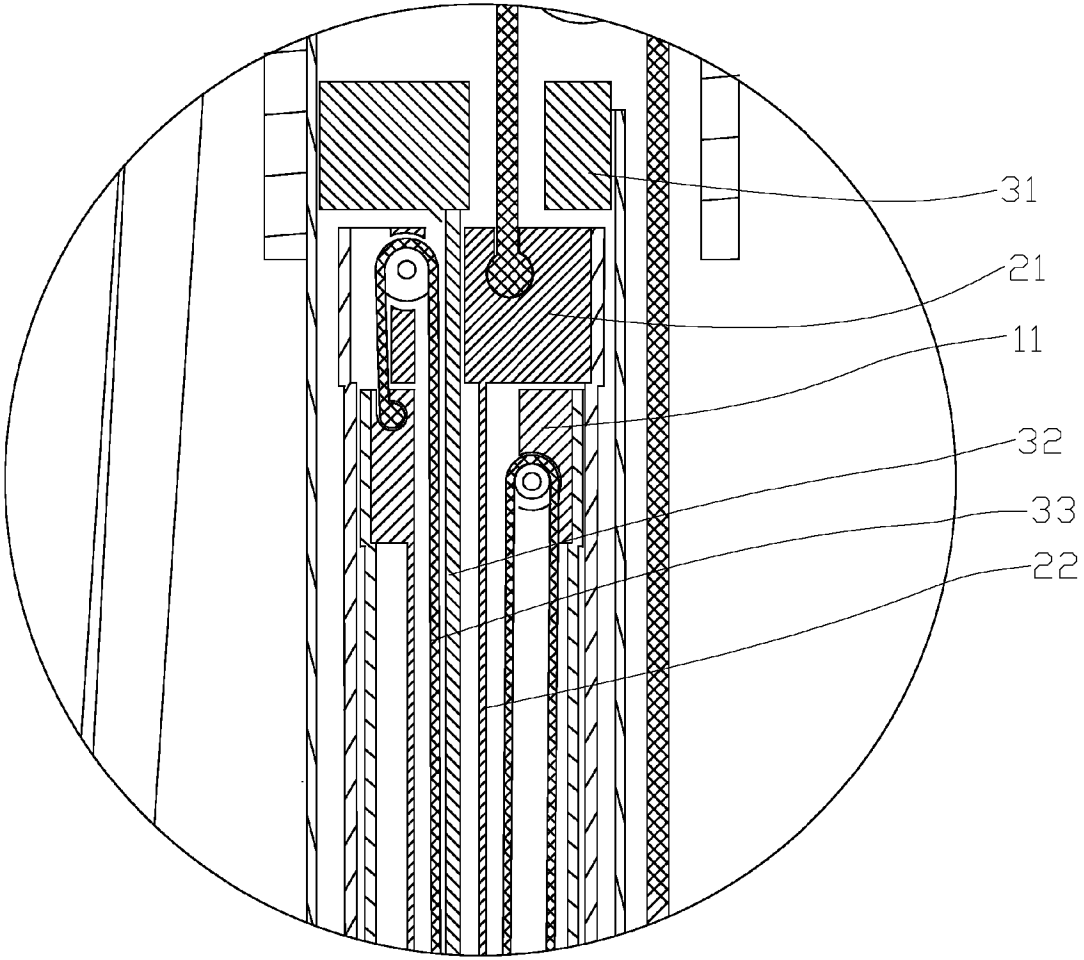
FIG. 7 is an amplified cross sectional view of a portion A of FIG. 6.

FIGS. 5 to 7 are a cross sectional view showing the assembly of the first stick section 1, the second stick section 2, and the third stick section 3, wherein the second stick section 2 is fitted with and slides on the outer wall of the first stick section 1, the first stick section 1 includes the first plug 11 disposed on the top end thereof, the second stick section 2 includes the second plug 21 mounted on the top end thereof, the first plug 11 of the first stick section 1 has the first through orifice 12 defined thereon, and the second stick section 2 also includes the first support member 22 fixed therein and formed in a cylinder shape, wherein the upper end of the first support member 22 is connected with the second plug 21, and the lower end of the first support member 22 is inserted into the first through orifice 12 of the first stick section 1. The first stick section 1 also includes the first pull rope 14 fitted therein and connecting with the lower end of the first support member 22 via the first fixing tab 13 on the first plug 11, and the lower end of the first pull rope 14 is rolled on the rolling mechanism 6. The third stick section 3 is fitted with and slides on the outer wall of the second stick section 2, and the third stick section 3 includes the third plug 31 fixed on the top end thereof, the second plug 21 of the second stick section 2 has the second through orifice 23 formed thereon. The third stick section 3 also includes the second support member 32 disposed thereon, wherein the upper end of the second support member 32 is coupled with the third plug 31, and the lower end of the second support member 32 is inserted into the first support member 22 formed in a cylinder shape via the second through orifice 23 of the second stick section 2. The second stick section 2 further includes the second pull rope 24 fitted therein and having an upper segment 241 for joining with the lower end of the second support member 32 via the second fixing tab 25 on the second plug 21. In addition, the first plug 1 has a third through orifice 15 defined thereon to insert the second support member 32, and a lower segment 242 of the second pull rope 24 is joined with the first plug 11. Due to the first support member 22 is formed in the cylinder shape, the second support member 32 moves downwardly to insert into the first support member 22, such that the second support member 32 is accommodated in the first support member 22 safely.

Preferably, the second support member 32 is formed in a sheet shape, a bar shape or a cylinder shape.

Each third stick section 3 of the first embodiment and the second embodiment further includes the lower runner 4 fitted thereon and the upper runner 5 mounted on the upper end thereof, wherein the upper runner 5 has the plural first stretchers 51, the plural second stretchers 52 fixed between the plural first stretchers 51 and the lower runner 4, and the plural springs 53 fitted between the plural second stretchers 52 and the plural first stretchers 51. The first stick section 1 further includes the rolling mechanism 6 fixed in the handle 7, wherein the lower end of the first pull rope 14 is rolled on the rolling mechanism 6. In this embodiment, the rolling mechanism 6 includes the micro motor 61 driven by the battery 67 and includes the rotating gear 63, wherein the micro motor 61 drives the rotating gear 63 to retract the first pull rope 14 through the driving gear 62 mounted on the output wheel 64, such that when the first pull rope 14 is rolled, its upper end pulls the first support member 22 upwardly, and the second stick section 2 is driven by the first support member 22 to slide upwardly. In operation, the upper segment 241 of the second pull rope 24 in the second stick section 2 pulls the second support member 32 upwardly, such that the third stick section 3 is driven by the second support member 32 to slide upwardly, thus stretching the first stick section 1, the second stick section 2, and the third stick section 3 completely. Furthermore, the third stick section 3 drives the plural first stretchers 51 and the plural second stretchers 52 to stretch outwardly. In the meantime, the first pull rope 14 is rolled by the rolling mechanism 6, and the button 65 controls the retaining piece 66 to engage with the rotating gear 63, thus fixing the automatic umbrella which is stretched. As desiring to fold the automatic umbrella, the button 66 controls the retaining piece 66 to disengage from the rotating gear 63, and the plural springs 53 operate, such that the first pull rope 14 is pulled downwardly by the first support member 22, the second pull rope 24 is pulled downwardly by the second support member 32, and the third pull rope 33 is pulled downwardly by the lower runner 4, thus folding the automatic umbrella.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A telescopic stick mechanism for an automatic umbrella at least comprising: a first stick section (1) and a second stick section (2), the second stick section (2) being fitted with and sliding on an outer wall of the first stick section (1), characterized in that the first stick section (1) includes a first plug (11) disposed on a top end thereof, and the second stick section (2) includes a second plug (21) mounted on a top end thereof, wherein the first plug (11) of the first stick section (1) has a first through orifice (12) defined thereon while the second plug (21) of the second stick section (2) also has a second through orifice (23) formed thereon, the second stick section (2) also includes a first support member (22) fixed therein, and an upper end of the first support member (22) is in connection with the second plug (21), a lower end of the first support member (22) is inserted into the first through orifice (12) of the first stick section (1), the first stick section (1) also includes a first pull rope (14) fitted therein and coupling with the lower end of the first support member (22) via a first fixing tab (13) on the first plug (11).

2. The telescopic stick mechanism for the automatic umbrella as claimed in claim 1 further comprising a third stick section (3) fitted with and sliding on an outer wall of the second stick section (2), characterized in that the second stick section (2) includes a second pull rope (24) fitted therein and having an upper segment (241) for joining with a lower segment (34) of the third stick section (3) through a second fixing tab (25) of the second plug (21); and a lower end of the second pull rope (24) is coupled with the first plug (11).

3. A telescopic stick mechanism for an automatic umbrella at least comprising: a first stick section (1), a second stick section (2), wherein said second stick section (2) is fitted with and sliding on an outer wall of the first stick section (1), and further, a third stick section (3), wherein said third stick section (3) is fitted with and sliding on an outer wall of the second stick section (2), characterized in that the first stick section (1) includes a first plug (11) disposed on a top end thereof, and the second stick section (2) includes a second plug (21) mounted on a top end thereof, wherein the first plug (11) of the first stick section (1) has a first through orifice (12) defined thereon, the second stick section (2) also includes a first support member (22) fixed therein, and an upper end of the first support member (22) is in connection with the second plug (21), a lower end of the first support member (22) is inserted into the first through orifice (12) of the first stick section (1), the first stick section (1) also includes a first pull rope (14) fitted therein and coupling with the lower end of the first support member (22) via a first fixing tab (13) on the first plug (11);

the third stick section (3) includes a third plug (31) fixed on a top end thereof, and the second plug (21) of the second stick section (2) has a second through orifice (23) formed thereon, the third stick section (3) also includes a second support member (32) disposed thereon, wherein an upper end of the second support member (32) is coupled with the third plug (31), and a lower end of the second support member (32) is inserted into the second through orifice (23) of the second stick section (2), the second stick section (2) further includes a second pull rope (24) fitted therein and joining with the lower end of the second support member (32) via a second fixing tab (25) on the second plug (21); and the first plug (1) has a third through orifice (15) defined thereon to insert the second support member (32).

4. A telescopic stick mechanism for an automatic umbrella at least comprising: a first stick section (1) and a second stick section (2), the second stick section (2) being fitted with and sliding on an outer wall of the first stick section (1), characterized in that the first stick section (1) includes a first plug (11) disposed on a top end thereof, and the second stick section (2) includes a second plug (21) mounted on a top end thereof, wherein the first plug (11) of the first stick section (1) has a first through orifice (12) defined thereon while the second plug (21) of the second stick section (2) also has a second through orifice (23) formed thereon, the second stick section (2) also includes a first support member (22) fixed therein and formed in a cylinder shape, and an upper end of the first support member (22) is in connection with the second plug (21), a lower end of the first support member (22) is inserted into the first through orifice (12) of the first stick section (1), the first stick section (1) also includes a first pull rope (14) fitted therein and coupling with the lower end of the first support member (22) via a first fixing tab (13) on the first plug (11); and a lower end of the first pull rope (14) is rolled on a rolling mechanism (6).

5. The telescopic stick mechanism for the automatic umbrella as claimed in claim 4 further comprising a third stick section (3) fitted with and sliding on an outer wall of the second stick section (2), characterized in that the third stick section (3) includes a third plug (31) fixed on a top end thereof, and the third stick section (3) also includes a second support member (32) disposed thereon, wherein an upper end of the second support member (32) is coupled with the third plug (31), and a lower end of the second support member (32) is inserted into the first support member (22) formed in the cylinder shape via the second through orifice (23) of the second stick section (2), the second stick section (2) further includes a second pull rope (24) fitted therein and having an upper segment (241) for joining with the lower end of the second support member (32) via the second fixing tab (25) on the second plug (21), and a lower segment (242) of the second pull rope (24) is joined with the first plug (11).

6. The telescopic stick mechanism for the automatic umbrella as claimed in claim 5, wherein the second support member (32) is formed in any one of a sheet shape, a bar shape, and a cylinder shape.

* * * * *